US007080958B1

(12) United States Patent
Morris

(10) Patent No.: US 7,080,958 B1
(45) Date of Patent: Jul. 25, 2006

(54) VIBRATORY PILE DRIVER/EXTRACTOR WITH TWO-STAGE VIBRATION/TENSION LOAD SUPPRESSOR

(75) Inventor: T. Richard Morris, Matthews, NC (US)

(73) Assignee: International Construction Equipment, Inc., Matthews, NC (US)

( * ) Notice: Subject to any disclaimer, the term of this patent is extended or adjusted under 35 U.S.C. 154(b) by 0 days.

(21) Appl. No.: 11/116,040

(22) Filed: Apr. 27, 2005

(51) Int. Cl.
*E02D 7/18* (2006.01)

(52) U.S. Cl. ..... 405/232; 173/162.1; 173/210

(58) Field of Classification Search ..... 405/232, 405/229; 173/162.1, 21
See application file for complete search history.

(56) References Cited

U.S. PATENT DOCUMENTS

| | | | | |
|---|---|---|---|---|
| 2,975,846 | A | 3/1961 | Bodine, Jr. | 175/19 |
| 3,362,485 | A | 1/1968 | Dyer, Sr. | 173/49 |
| 3,394,766 | A | 7/1968 | Lebelle | 173/49 |
| 3,502,160 | A | 3/1970 | Herz | 173/49 |
| 3,828,864 | A | 8/1974 | Haverkamp et al. | 173/49 |
| 3,865,501 | A | 2/1975 | Kniep | 404/133 |
| 3,909,149 | A | 9/1975 | Century | 404/133 |
| 4,018,290 | A | 4/1977 | Schmidt | 173/49 |
| 4,061,196 | A | 12/1977 | Herz | 173/49 |
| 4,100,974 | A | 7/1978 | Pepe | 173/49 |
| 4,143,179 | A | 3/1979 | Furukawa et al. | 173/1 |
| 4,274,761 | A | 6/1981 | Boguth | 405/232 |
| 4,616,716 | A | 10/1986 | Bouplon | 173/49 |
| 4,625,811 | A | 12/1986 | Tuenkers | 173/49 |
| 4,645,017 | A | 2/1987 | Bodine | 173/162 R |
| 4,650,008 | A | 3/1987 | Simson | 173/91 |
| 4,819,740 | A | 4/1989 | Warrington | 173/49 |
| 5,088,565 | A | 2/1992 | Evarts | 173/49 |
| D326,857 | S | 6/1992 | Ikeda et al. | D15/21 |
| 5,117,925 | A | 6/1992 | White | 173/162.1 |
| 5,167,396 | A | 12/1992 | Burba et al. | 248/610 |
| 5,168,938 | A | 12/1992 | Sano et al. | 173/11 |
| 5,263,544 | A | 11/1993 | White | 173/162.1 |
| 5,568,997 | A | 10/1996 | Raunisto | 405/232 |
| 5,725,329 | A | 3/1998 | Chelminski | 405/232 |
| 6,543,966 | B1 * | 4/2003 | White | 405/232 |
| 6,691,797 | B1 * | 2/2004 | Hart | 405/232 |

OTHER PUBLICATIONS

Specification sheet, Model 416L, *Hydraulic Vibratory Driver/Extractor*, International Construction Equipment, Inc., Matthews, NC 28104, www.iceusa.com.

* cited by examiner

*Primary Examiner*—Frederick L. Lagman
(74) *Attorney, Agent, or Firm*—Kennedy Covington Lobdell & Hickman, LLP

(57) ABSTRACT

A method and apparatus for driving and extracting piles that includes a vibration/tension load absorber assembly mounted between a housing and the vibratory unit which includes shear-type vibration absorbers connected between the housing and the vibratory unit and operating in combination with at least one compression-type vibration absorber positioned to be compressed between first and second compression plates when the tension load reaches a predetermined level.

17 Claims, 11 Drawing Sheets

VIBRATORY PILE DRIVER/EXTRACTOR WITH TWO-STAGE VIBRATION/TENSION LOAD SUPPRESSOR

BACKGROUND OF THE PRESENT INVENTION

The present invention relates generally to devices or rigs for driving piles and the like into the ground and for extracting piles that have been driven into the ground, and more particularly to rigs of this type that are provided with a vibration/tension load suppressor for absorbing vibration and tension loads generated by the driving and extracting operations.

Vibratory pile driver/extractors which are used for driving and extracting piles and the like generally include a vibratory unit that is connected to a housing which in turn is connected to a cable or other support that lowers and lifts the housing and vibratory unit during the driving and extracting operations, respectively. The vibratory unit is connected to the pile and usually includes rotating eccentrics that impart vibrations to the pile to assist in driving and extracting the pile.

During driving operations, the housing and vibratory unit are positioned on top of the pile itself and to a large extent are supported thereby. Therefore, there is little or no tension load on the cable as it lowers the housing and vibratory unit while the pile is driven into the ground. However, during pile extracting operations, the cable must not only bear the dead weight of the housing and vibratory unit, it is also subjected to the high tension loads required to extract the pile from the ground. Vibration and tension loads generated during the pile extraction operation can damage the supporting cable and hoisting machinery if the vibration and tension loads are not properly absorbed.

In early designs, springs were provided as vibration/tension load absorbers, but because the tension loads varied so much, depending on whether the rig was driving or extracting piles, it was necessary to manually adjust the stiffness of the springs each time the rig changed from pile driving and pile extracting operations, and vice versa. This arrangement had the major disadvantage of being both time consuming and labor intensive.

Another vibration/tension load absorbing arrangement is disclosed in Herz U.S. Pat. No. 3,502,160. To avoid the problem of having to manually adjust the vibration/tension load absorbing springs, this patent utilizes two different sets of compression springs acting between a yoke and the vibratory unit or body, with one set having a greater stiffness than the other. The first set of weaker springs is connected between the yoke and the vibratory unit and is designed to maintain the yoke and the vibratory unit in fixed relation to one another during pile driving operations when there is little or no tension load on the cable. The second set of springs is stiffer than the first set, whereby during pile extracting operations the higher tension load on the cable is taken over by the set of stiffer springs when the tension load reaches a predetermined level. One disadvantage of this arrangement is that during pile driving operations, when there is generally some tension maintained in the cable, the vibration imparted to the cable is not absorbed since the first set of weaker springs maintains the yoke and the vibratory unit in fixed, rigid relation to one another. Additionally, during pile extracting operations, when the tension load exceeds the level at which the set of stiffer springs come into play, the first set of weaker springs become essentially non-functional and do not supplement the tension absorbing action of the set of stiffer springs.

Kniep U.S. Pat. No. 3,865,501 discloses a soil compactor that is operated by a vibratory unit carried on a housing by multiple compression springs that appears to be generally similar to the Herz arrangement, but since the Kniep patent does not include any detailed description of the compressions springs and their operation, it is not clear exactly how the multiple springs operate.

In White U.S. Pat. Nos. 5,117,925 and 5,263,544, pile driving and extracting rigs are disclosed which include multi-stage vibration/tension load absorbing elements for absorbing the vibration generated by a vibratory unit and tension loads. In these rigs, some of the vibration/tension load absorbing elements are connected between a base section and an intermediate section, and others of the vibration/tension load absorbing elements are connected between the intermediate section and a connection section. All of the vibration/tension load absorbing elements are in the form of horizontally extending elastomeric members arranged to absorb the loads by shear strain. The elastomeric members have varying thicknesses, and the vibration loads and tension loads are absorbed in stages. While these shear members are capable of absorbing loads encountered in conventional pile driving and pile extracting rigs, each member has a somewhat limited vibration and tension load absorbing capacity, and therefore in instances where the tension loads are very high, the number of vibration/tension load absorbing elements must be increased, all of which can increase the expense of the rig and the size of rig that must accommodate the increased number of shear members.

In accordance with the present invention, an apparatus for driving and extracting piles is provided which overcomes drawbacks of known devices of this type, and which provides an improved arrangement for absorbing vibration and tension loads associated with devices of this type.

SUMMARY OF THE PRESENT INVENTION

Briefly summarized, the present invention provides an apparatus for driving and extracting piles using a vibratory and tension force which includes a housing adapted to be connected to a support (e.g. a cable) that lifts and lowers the housing, the housing having at least one wall portion, and a vibratory unit adapted to be connected to a pile and generating a vibratory force for driving and extracting a pile. At least one first vibration/tension load absorbing element is connected between the wall portion of the housing and the vibratory unit, such first vibration/tension load absorbing element being formed of an elastomeric material for absorbing vibration and tension loads by shear strain and being positioned to absorb vibration generated by the vibratory unit and tension load applied by the support. At least one second vibration/tension load absorbing compression element formed of an elastomeric material is positioned between the housing and the vibratory unit to be compressed between the housing and the vibratory unit to absorb vibration generated by the vibratory unit and tension load generated by the support when the tension load applied by the support exceeds a predetermined level.

In the preferred embodiment of the present invention, the housing has a first compression plate mounted thereon, and the vibratory unit has a second compression plate mounted thereon in spaced relation to the first compression plate so that the tension load applied by the support results in the first and second compression plates moving toward one another. The second vibration/tension load absorbing element is mounted on one of the first or second compression plates in the spacing between the first and second compression plates.

The second vibration/tension load absorbing element can be positioned between the first and second compression plates to stop further movement of the first and second compression plates toward one another when the second vibration/tension load absorbing element is fully compressed by the first and second compression plates so that the second vibration/tension load absorbing element also acts as a stop when it is fully compressed.

Preferably, the first vibration/tension load absorbing elements are constructed and arranged so that they will continue to absorb vibration by shear strain after the tension load applied by the support exceeds the predetermined level at which the second vibration/tension load absorbing element begins its vibration and tension load absorbing function.

Also, in accordance with one feature of the present invention, a rigid member may be mounted on one of the first and second compression plates to extend in a direction toward the other of the first and second compression plates. The extending length of the rigid member is substantially equal to the maximum height of the second vibration/tension load absorbing element when it is fully compressed between the first and second compression, so that when the second vibration/tension load absorbing element is fully compressed the rigid element is engaged by one of the first and second compression plates and acts as a stop to prevent further movement of the first and second compression plates toward one another. The rigid element and the first and second compression plates are preferably made of metal so that a sound is generated by the engagement of the rigid member with one of the first and second compression plates. The rigid element may be a bolt with a head, and the second vibration absorbing member may be held in place by the bolt and may be formed with an opening through which the head of the bolt can extend to engage one of the first and second compression plates when the second vibration/tension load absorbing element is fully compressed.

In another embodiment, the rigid member may be a bracket and the second vibration/tension load absorbing element may be held in place by the bracket being secured to one of the first and second compression plates. The height of the bracket above the compression plate to which it is secured is substantially equal to the maximum height of the second vibration/tension load absorbing element when it is fully compressed between the first and second compression so that when the second vibration/tension load absorbing element is fully compressed the bracket is engaged by one of the first and second compression plates and acts as a stop to prevent further movement of the first and second compression plates toward one another. In this embodiment, the bracket and the first and second compression plates are preferably made of metal, whereby a sound is generated by the engagement of the bracket with one of the first and second compression plates.

It is preferred that the plurality of first elastomeric vibration/tension load absorbing elements be mounted between the wall portion of the housing and the vibratory unit, and that each such first elastomeric vibration/tension load absorbing element extend generally horizontally when there is no tension load imposed thereon and distorts vertically under the influence of the shear strain.

The present invention also includes a method of absorbing the vibration and tension loads generated by a vibratory unit carried in a housing and connected to a pile for driving and extracting the pile. The method includes the steps of raising and lowering the housing and the vibratory unit using a support; absorbing the vibration generated by the vibratory unit and absorbing the tension load applied by the support utilizing shear strain; and absorbing the vibration generated by the vibratory unit and absorbing the tension load applied by the support using an elastomeric compression element positioned to be compressed between the vibratory unit and the housing whenever the tension load generated by the support exceeds a predetermined level. This method may also include the step of generating an audible sound of metal engaging metal when the compression element positioned between the vibratory unit and the housing is fully compressed by the tension load.

BRIEF DESCRIPTION OF THE DRAWINGS

Further features, embodiments, and advantages of the present invention will become apparent from the following detailed description with reference to the drawings, wherein.

DETAILED DESCRIPTION OF PREFERRED EMBODIMENTS

Figure 1:
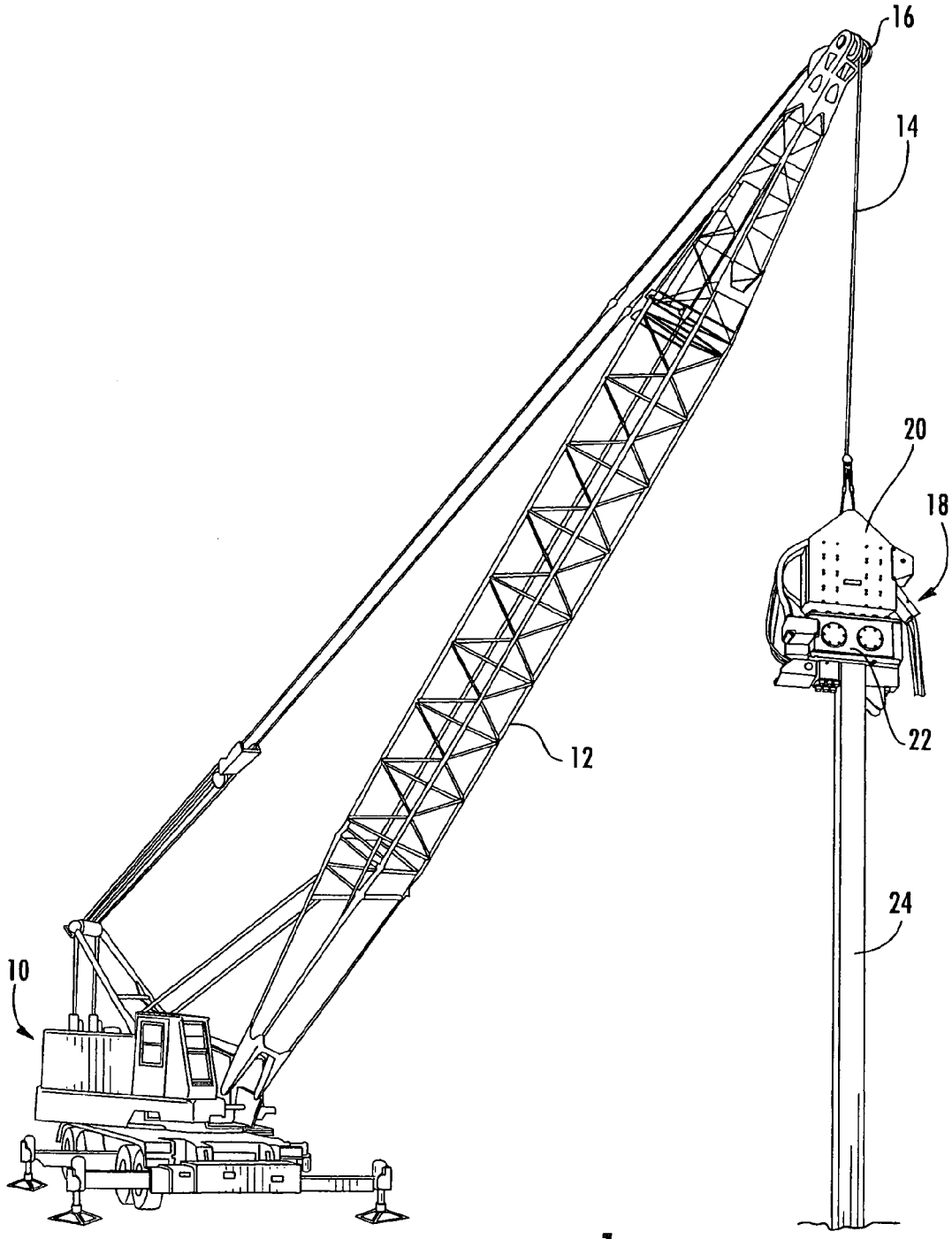
FIG. 1 is a general view of a rig for driving and extracting piles which embodies the present invention.

Looking now in greater detail at the accompanying drawings, FIG. 1 illustrates a typical pile driving and extracting rig with which the vibration/tension load absorbing features of the present invention may be utilized. This rig includes a crane 10 having a boom 12 that is pivotally mounted on the crane 10. A support cable 14 extends upwardly through the boom 12 and over a pulley 16 at the top of the boom 12, and the end of the cable 14 supports a vibratory pile driver/extractor 18. The vibratory pile driver/extractor 18 includes a housing 20, and a vibrator 22 which is mounted within the housing 20 in a manner to be described in greater detail below.

In operation, the crane 10 manipulates the vibratory pile driver/extractor 18 over a pile 24 so that the vibrator 22 can engage the upper end of the pile 24 as illustrated in FIG. 1. The cable 14 is then extended or retracted to raise or lower the vibratory pile driver/extractor 18, depending on whether the pile 24 is being extracted from the ground or driven into the ground, and the vibration imparted to the pile by the vibrator 22 assists in driving the pile 24 into the ground or extracting the pile 24 out of the ground.

While the rig illustrated in FIG. 1 and described above is the most common arrangement for supporting and manipulating the vibratory pile driver/extractor 18, it is also well known in the art that the vibratory pile driver/extractor 18 can be directly supported by equipment other than a crane 10. For example, the vibratory pile driver/extractor 18 could be mounted directly on the "stick" of an excavator (not shown), or directly supported on a forklift (not shown).

Figure 2:
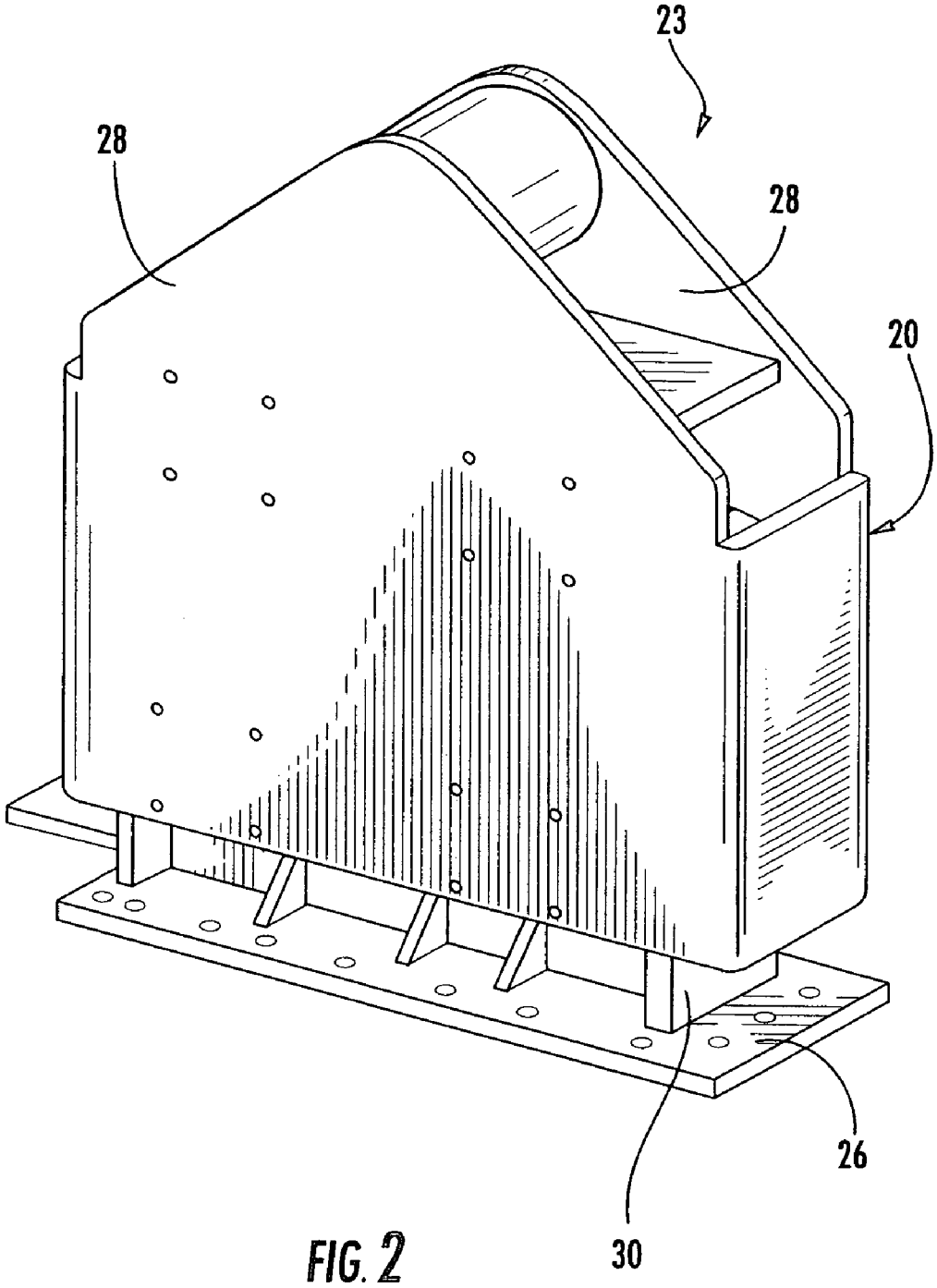
FIG. 2 is a perspective view of the vibration/tension load suppressor of the rig.
Figure 3:
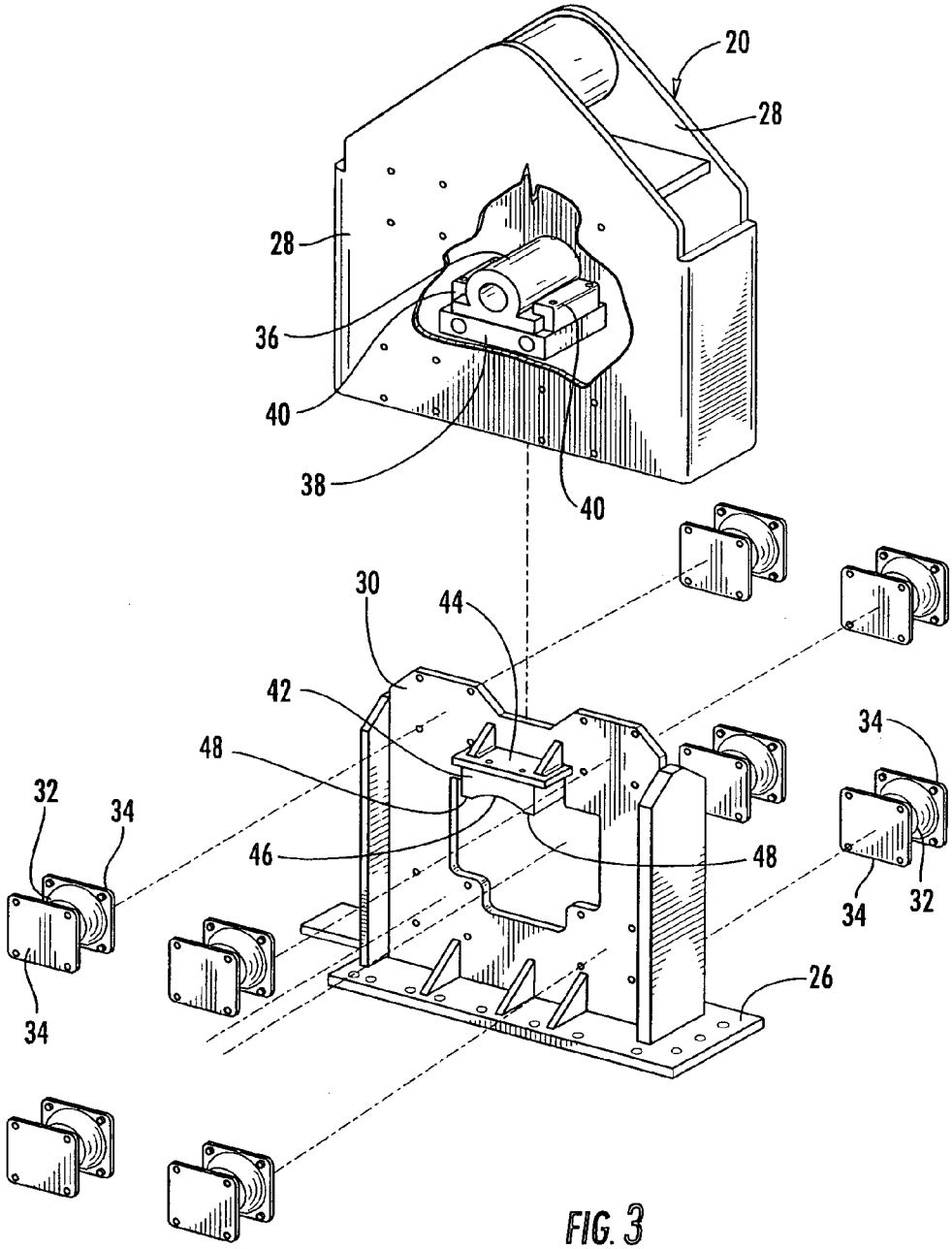
FIG. 3 is an exploded view, partially in section, of the vibration/tension load suppressor illustrated in FIG. 2.

The vibratory/tension load suppressor 23 portion of the vibratory pile driver/extractor 18 is best seen in FIGS. 2 and 3. The vibrator 22 includes an upper plate 26, and the housing 20 includes two generally flat sidewalls 28 that extend vertically in spaced parallel relation to one another. The upper plate 26 includes a vertically extending center wall portion 30 that extends upwardly into the spacing between the housing sidewalls 28.

Figure 4:
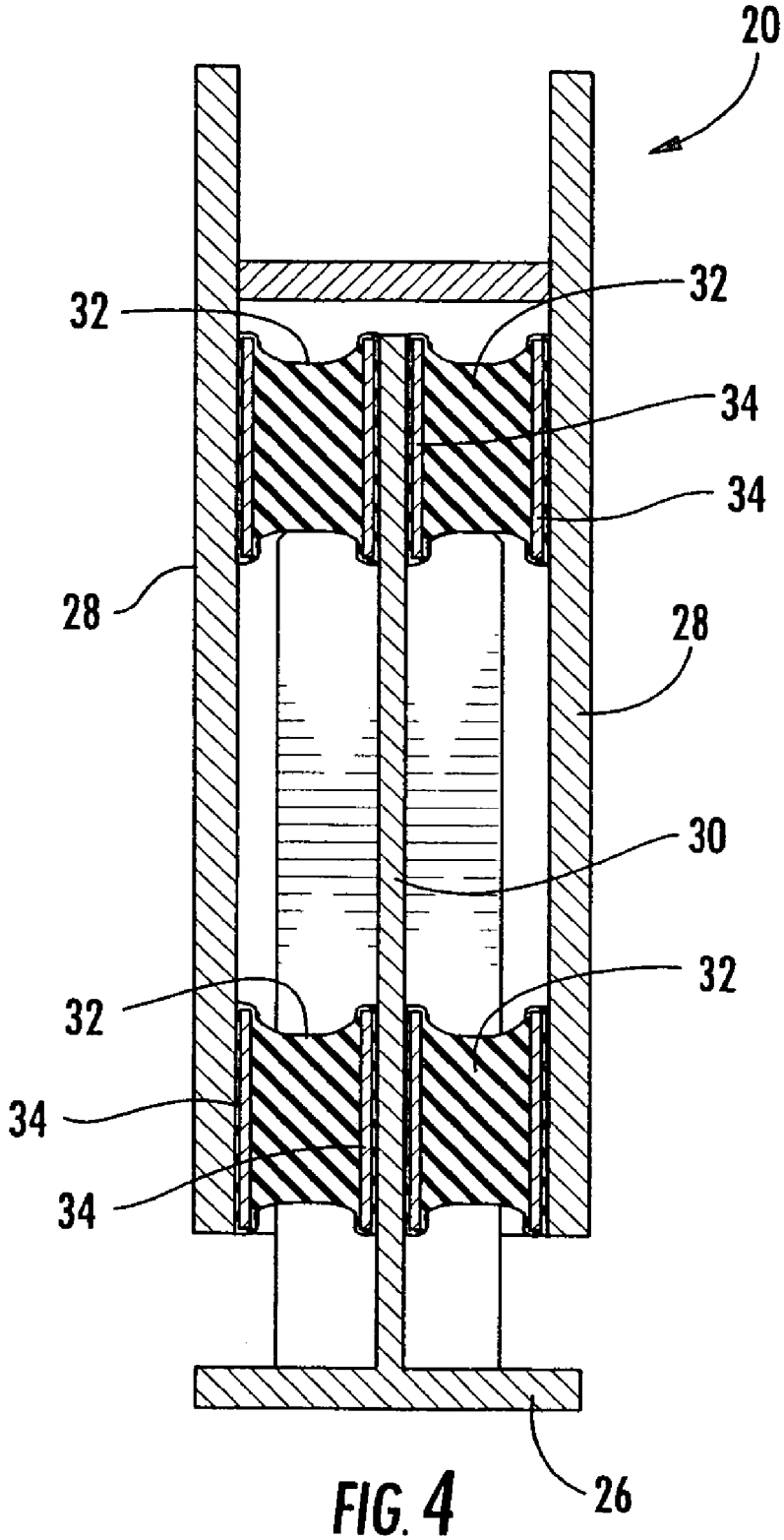
FIG. 4 is a side elevational view taken through line 4—4 in FIG. 5A showing the connection of the shear-type elastomeric members between the housing and the vibratory unit of the rig.

As best seen in FIGS. 3 and 4, the center wall portion 30 of the upper plate 26 of the vibrator 22 is mounted to the sidewalls 28 of the housing 20 by a plurality of shear-type vibration/tension load absorbing elements 32, which in the preferred embodiment of the present invention are in the form of generally cylindrical elastomeric elements that extend on their horizontal axes between the center wall portion 30 of the upper plate 26 and the sidewalls 28. Each of the shear-type vibration/tension load absorbing elements 32 includes a pair of mounting plates 34 located at the ends thereof so that one end of the vibration/tension load absorbing elements 32 can be mounted to one of the side walls 28, and the other end can be mounted to the center wall portion 30. It will be understood that the number, location, and configuration of the shear-type vibration/tension load absorbing elements 32 can be varied depending on the particular application of the vibratory pile driver/extractor 18, and the loads likely to be encountered by the vibratory pile driver/extractor 18.

Figure 5A:
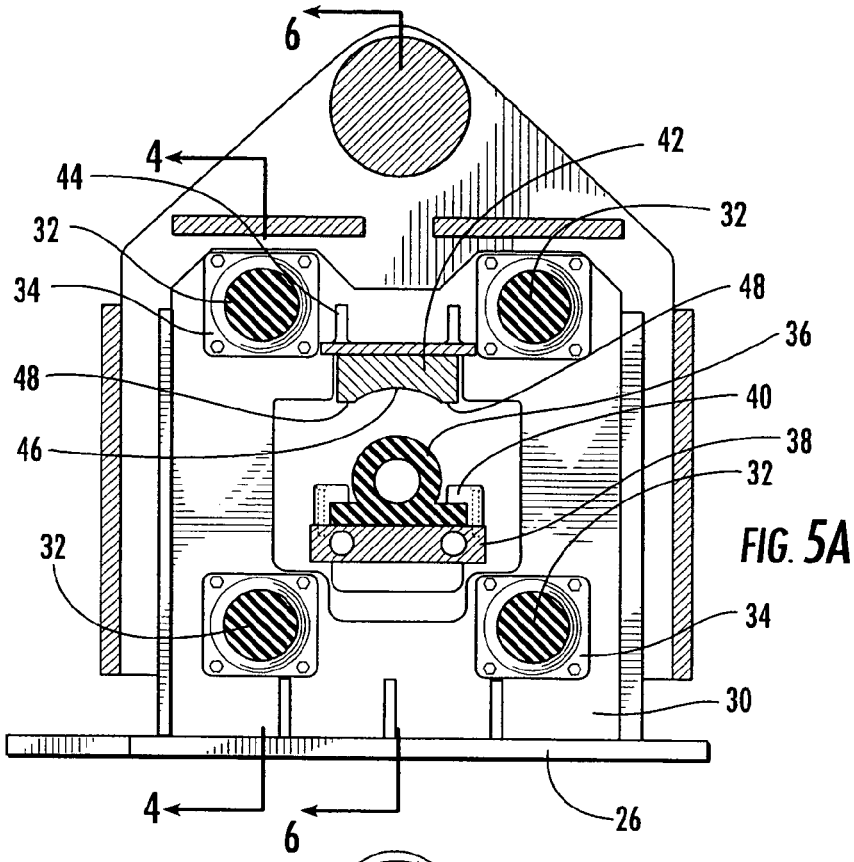
FIGS. 5A, 5B, and 5C show the elastomeric shear members and the elastomeric compression member acting as vibration/tension load absorbing elements when vibratory and tension loads are being applied.

In addition to the shear-type vibration/tension load absorbing elements 32, and as best seen in FIGS. 3 and 5A, at least one compression-type vibration/tension load absorbing element 36 is mounted on top of a first compression plate 38 that is mounted on one or both of the housing sidewalls 28 to extend therebetween. In the preferred embodiment of the present invention that is illustrated in FIGS. 1–6, the compression-type vibration/tension load absorbing element 36 is a conventional wing-type compression element that is mounted on the first compression plate 38 by a pair of L-shaped brackets 40 that extend over the horizontal wings of the compression-type vibration/tension load absorbing element 36. While it is believed that the wing-type compression vibration/tension load absorbing elements 36 will work best in most applications of the vibration absorbing apparatus of the present invention, it is to be understood that other types of compression-type vibration absorbers could also be used, if desired.

The compression-type vibration/tension load absorbing element 36 is mounted on the first compression plate 38 so as to be positioned directly beneath a second compression plate 42 which is fixed to a mounting plate 44 which, in turn, is mounted on the center wall portion 30. For a purpose to be described in greater detail below, the bottom face of the second compression plate 42 may be configured to have a curved center portion 46 and two flat end portions 48.

Figure 5B:
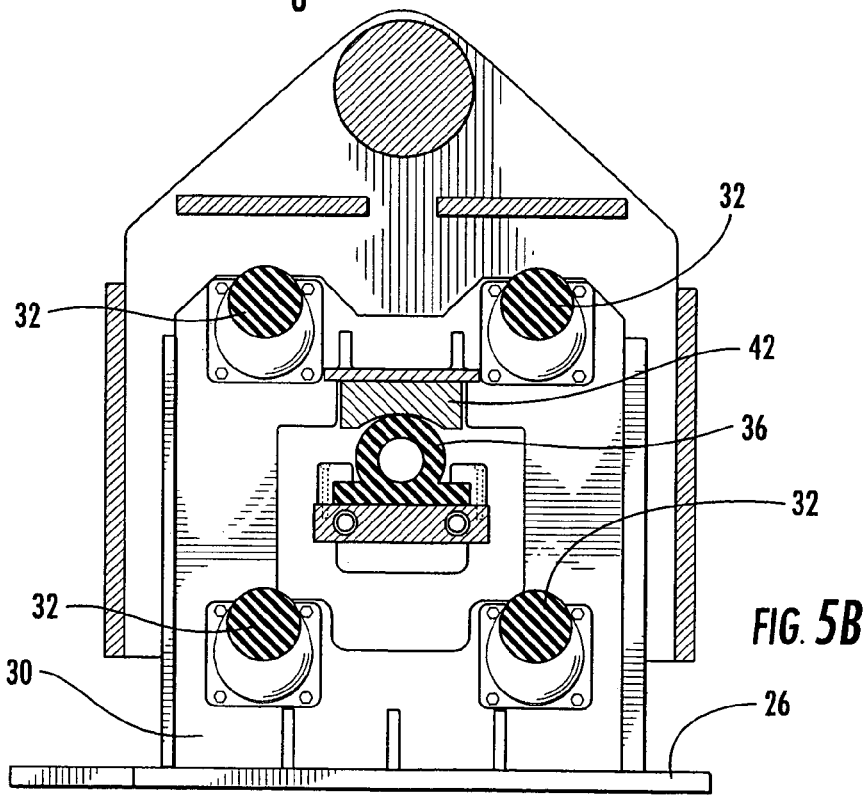
Figure 5C:
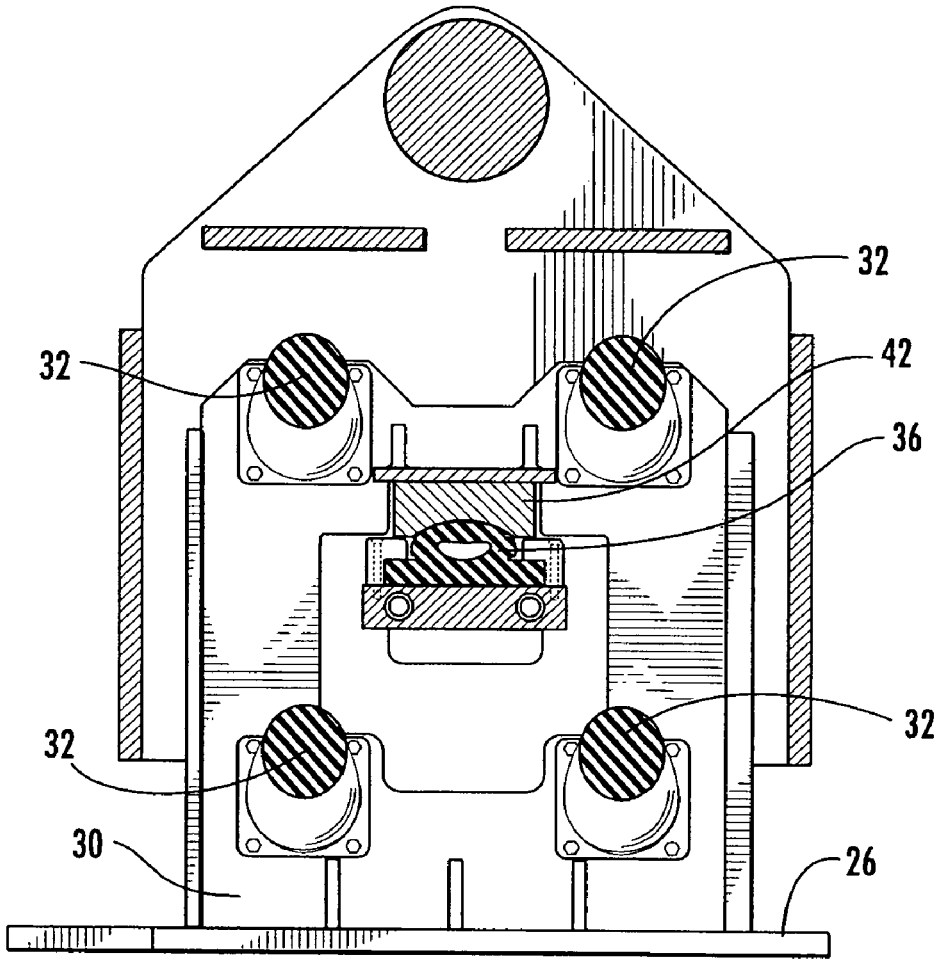

As explained in greater detail above, when the pile driving and extracting rig is used to extract piles, the vibratory pile driver/extractor 18 is subjected to vibratory loads generated by the conventional rotating eccentrics (not shown) within the vibrator 22 and, more importantly, the vibratory pile driver/extractor 18 is subjected to very high tension loads created by the difficulty of raising and extracting a sunken pile from the ground. FIGS. 5A–5C, which are sectional views taken along a vertical plane of a front view, and FIGS. 6A–6C, which are corresponding sectional views taken along a vertical plane of a side view, illustrate the interaction of the shear-type vibration absorber elements 32 and the compression-type vibration/tension load absorbing element 36 when the vibratory pile driver/extractor 18 is subjected to these loads.

Figure 6A:
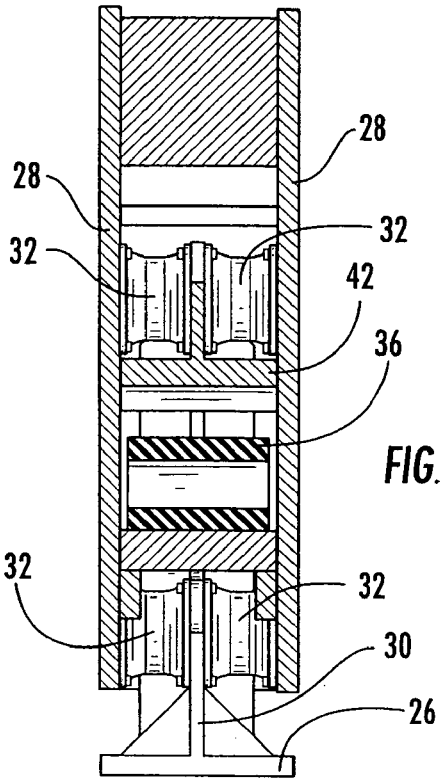
FIGS. 6A, 6B, and 6C are side views of the elastomeric shear members and the elastomeric compression member illustrated in FIGS. 5A, 5B and 5C, taken along line 6—6 in FIG. 5A.

More specifically, FIGS. 5A and 6A illustrate the vibratory pile driver/extractor 18 under a no-tension-load condition. In this condition, it will be noted that the shear-type vibration/tension load absorbing elements 32 extend generally horizontally between the sidewalls 28 of the housing 20 and the center wall portion 30 of the vibrator upper plate 26. Since there is essentially no significant tension load, there is no significant deflection of the shear-type vibration/tension load absorbing elements 32. It will also be noted that in this condition the second compression plate 42 is positioned to be spaced above and out of contact with the compression-type vibration/tension load absorbing element 36.

Figure 6B:
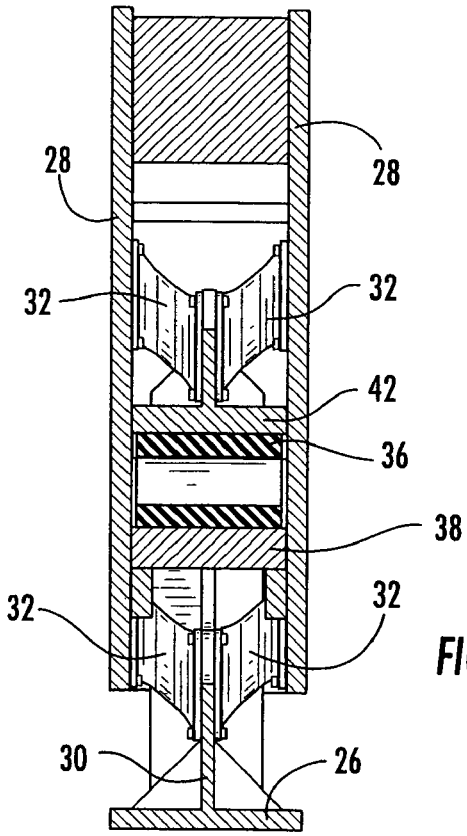

However, when the rig begins to extract a pile 24 from the ground, the tension load increases, and the shear-type vibration/tension load absorbing elements 32 begin to deform in a vertical direction and thereby absorb the vibration and tension loads by shear-strain as center wall portion 30 the upper plate 26 of the vibrator 22 moves vertically downward within the spacing between the sidewalls 28 of the housing 20, all in a manner well known in the art. This vibration and tension load absorbing action will continue from the no-tension-load condition until the tension load reaches a predetermined level, and, in accordance with the present invention, when the tension load reaches that predetermined level, the vertical movement of the center wall portion 30 of the vibrator 22 relative to the sidewalls 28 of the housing 20 will have increased to a point that is illustrated in FIGS. 5B and 6B. At this point, the shear-type vibration/tension load absorbing elements 32 are significantly deformed in a vertical direction, and the second compression plate 42 makes initial contact with the top surface of the compression-type vibration/tension load absorbing element 36, as best illustrated in FIG. 5B. If the tension load increases beyond this predetermined level, the shear-type vibration/tension load absorbing elements 32 will continue to absorb vibration and tension loads by shear-strain and further deflection in a vertical direction, and, in addition, the compression-type vibration/tension load absorbing element 36 is now compressed by the vertical movement of the first compression plate 38 toward the second compression plate 42, whereby the compression-type vibration/tension load absorbing element 36 provides significant tension load absorbing capability in addition to the tension load absorbing action of the shear-type vibration/tension load absorbing elements 32.

Figure 6C:
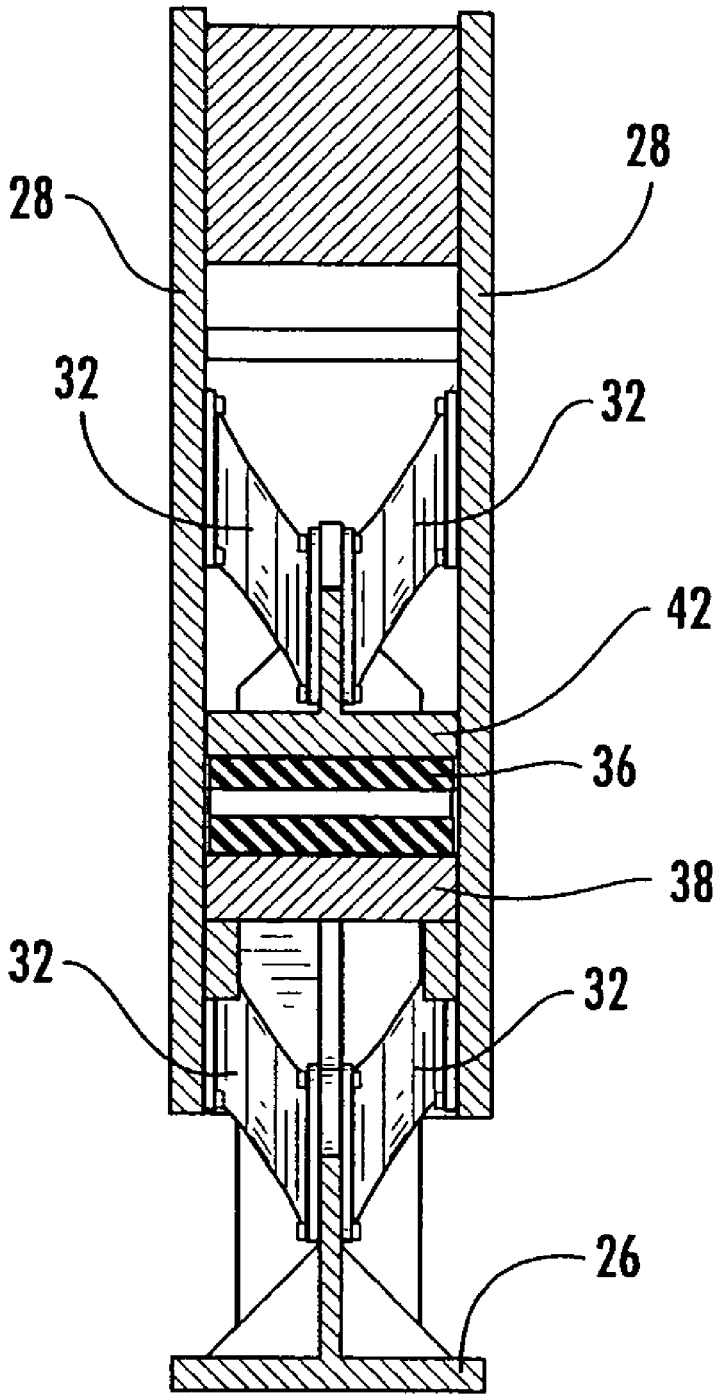

This dual action of the shear-type vibration/tension load absorbing elements 32 and the compression-type vibration/tension load absorbing element 36 will continue until the tension load exceeds the predetermined level to such an extent that the compression-type vibration/tension load absorbing element 36 is fully compressed between the first compression plate 38 and the second compression plate 42 as illustrated in FIGS. 5C and 6C. At this point, the flat end portions 48 of the lower face of the second compression plate 42 contact the upper surface of the two mounting brackets 40 which thereby prevents any further relative movement of the vibrator 22 relative to the housing 20. In accordance with one feature of the present invention, both the second compression plate 42 and the mounting brackets 40 are made of metal, and when the tension load reaches the high level at which the second compression plate 42 makes contact with the mounting brackets 40, an audible clanging sound is generated as metal strikes metal. This audible sound constitutes a warning to the operator of the rig that the vibratory pile driver/extractor 18 has reached the maximum tension load that it can reasonably absorb, whereby the operator can make appropriate adjustments to the operation of the rig to decrease the tension load on the vibratory pile driver/extractor 18.

In the preferred embodiment of the present invention the compression-type vibration/tension load absorbing element 36 is mounted on the first compression plate 38 but it will be understood that the compression-type vibration absorber could just as readily be mounted on the bottom surface of the second compression plate 42. In that arrangement, the first compression plate 38 would have a configuration like that described above for the second compression plate 42. It will be understood that while the preferred configuration of the second compression plate 42 includes the curved center portion 46 as described above and as illustrated in the drawings, the second compression plate 42 could also be formed with a flat surface configuration if desired.

Figure 9:
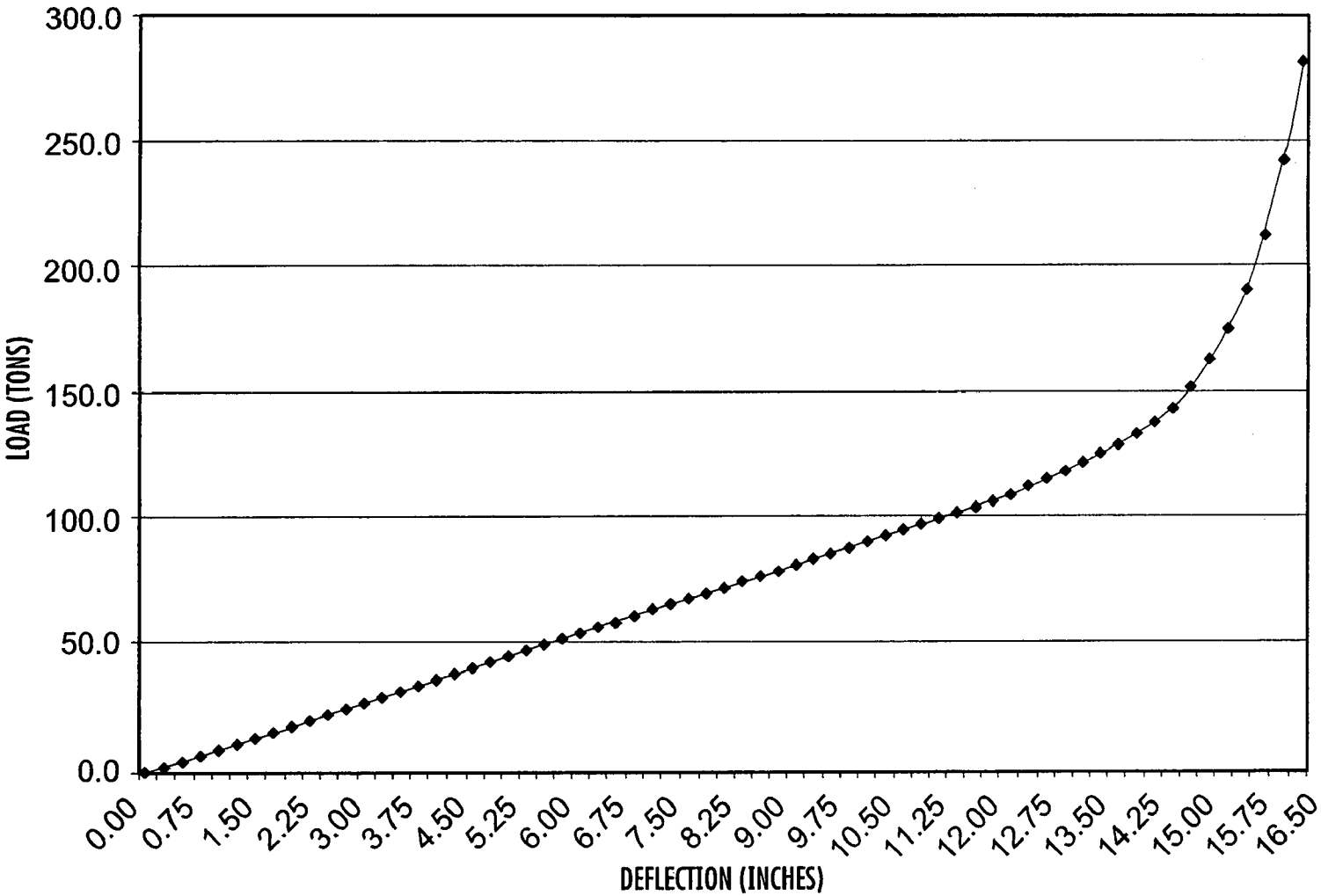
FIG. 9 is a chart showing the relationship between increasing tension load and accompanying deflection in a typical rig utilizing the vibration/tension load absorbing features of the present invention.

It will be appreciated from the description above that the present invention provides a unique vibration and tension load absorbing capability that utilizes traditional shear-strain vibration and tension load absorption offered by known shear-type vibration/tension load absorber elements operating in concert with a compression-type vibration/tension load absorber element that is uniquely capable of absorbing high tension loads that may be encountered when the tension loads exceed a predetermined level. This interplay is illustrated by a typical chart shown in FIG. 9, which is exemplary only, wherein the Y-coordinate is the tension load in tons, and the X-coordinate represents the vertical deflection of the vibrator 22 relative to the housing 20 utilizing the vibration and tension load absorbing arrangement of the present invention. In FIG. 9, it will be noted that as long as the tension load remains beneath a predetermined level, there is a generally straight line relationship between the tension load and the deflection, which results from the vibration and tension load absorbing action of the shear-type vibration/tension load absorbing elements 32. However, when the tension load reaches a predetermined level, which is approximately 125 tons in the illustrative chart shown in FIG. 9, the compression-type vibration/tension load absorbing element 36 comes into play, and the straight line relationship between the load and deflection changes significantly and assumes a much steeper curve indicating that substantial load increases can be absorbed by the compression-type vibration/tension load absorbing element 36 with only a small degree of deflection.

Figure 7:
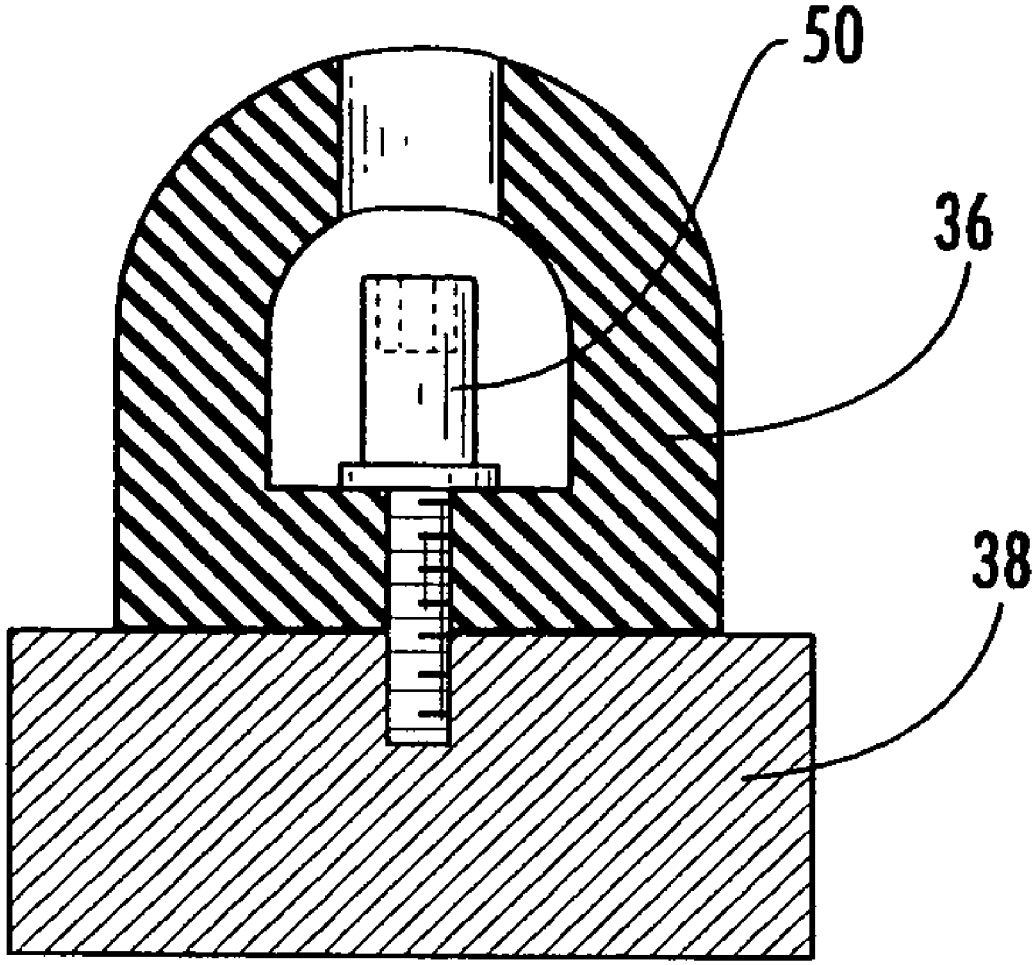
FIG. 7 is a detail sectional view of an alternate embodiment of the compression member of the present invention.

FIG. 7 illustrates an alternate embodiment of the present invention in which a conventional D-shaped compression-type vibration/tension load absorbing element 36 is used. The compression-type vibration/tension load absorbing element 36 is mounted on the first compression plate 38 by a bolt 50, and the top of the D-shaped compression-type vibration/tension load absorbing element 36 is formed with an opening that is slightly larger than the head of the bolt 50. Accordingly, in this embodiment, when the vibration/tension load absorbing element 36 reaches its fully compressed condition, the head of the bolt 50 will pass upwardly through the opening and it will be struck by the bottom surface of the second compression plate 42 to create a audible clanging sound similar to the clanging sound described above.

Figure 8:
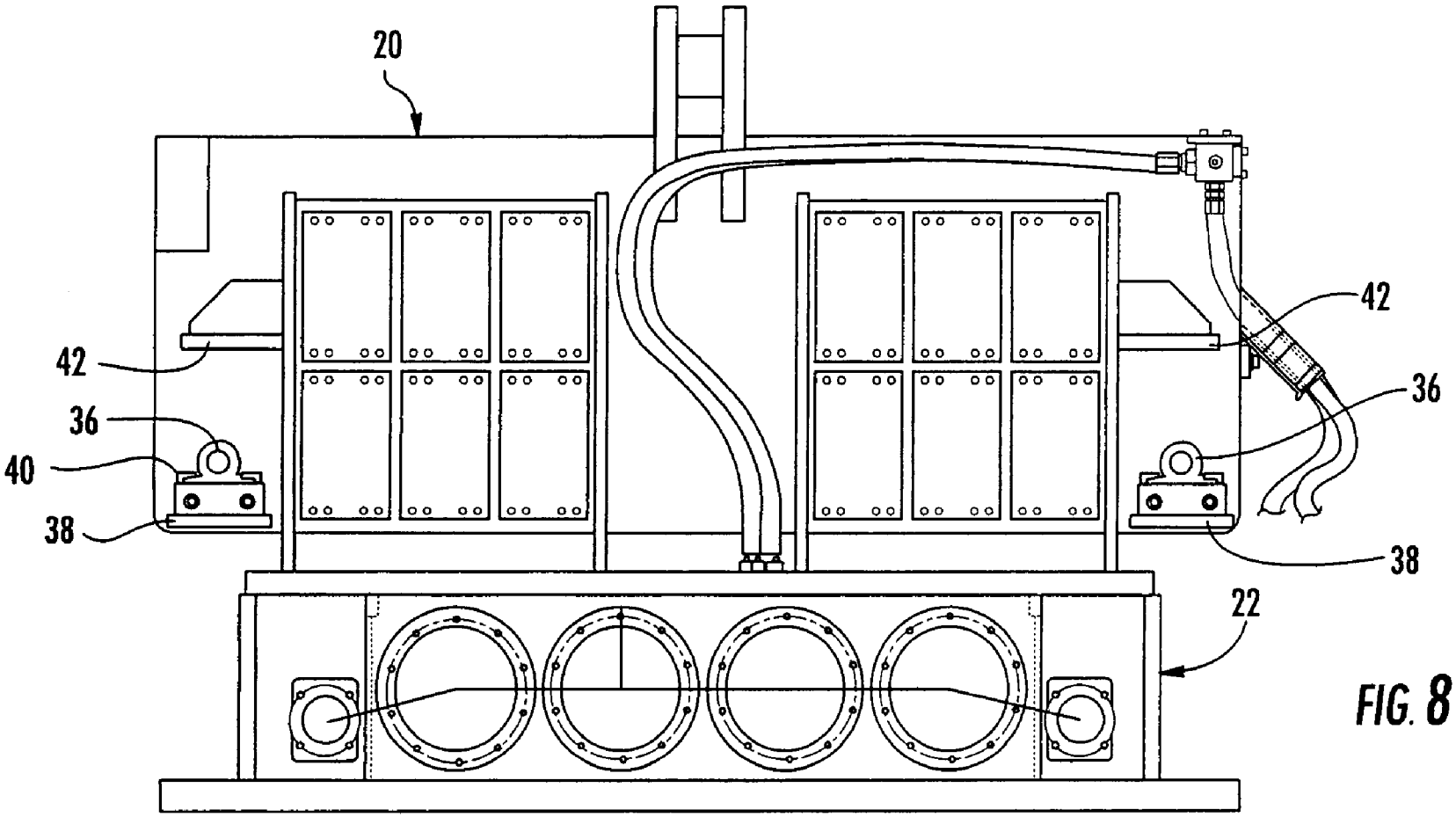
FIG. 8 is a side view showing an alternate embodiment of the housing and the vibratory unit, and the location of the compression members therebetween.

It will be appreciated that in some applications, particularly where there are very high tension loads to be encountered, it may be necessary or desirable to increase the number of compression-type vibration/tension load absorbing elements 36, and one suitable alternative embodiment of the present invention is illustrated in FIG. 8. In this embodiment, two compression-type vibration/tension load absorbing elements 36 are mounted on two first compression plates 38, and two second compression plates 42 are mounted on the vibrator 22 above the compression-type vibration/tension load absorbing elements 36. In this embodiment of the present invention, the compression of the compression-type vibration/tension load absorbing elements 36 between the first compression plates 38 and the second compression plates 42 is identical to that described above, except that in this embodiment there are multiple compression-type vibration absorber elements 36.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. Apparatus for driving and extracting piles using a vibratory and tension force, such apparatus comprising:

(a) a housing adapted to be connected to a support that lifts and lowers the housing and having at least one wall portion;

(b) a vibratory unit adapted to be connected to a pile and generating a vibratory force for driving and extracting a pile;

(c) at least one first vibration/tension load absorbing element connected between the wall portion of the housing and the vibratory unit, such first vibration/tension load absorbing element being formed of an elastomeric material for absorbing vibration and tension loads by shear strain and being positioned to absorb by shear stain the vibration generated by the vibratory unit and tension load applied by the support; and (d) at least one second vibration/tension load absorbing compression element formed of an elastomeric material and positioned between the housing and the vibratory unit to be compressed between the housing and the vibratory unit to absorb vibration generated by the vibratory unit and to absorb the tension load generated by the support when the tension load generated by the support exceeds a predetermined level.

2. Apparatus for driving and extracting piles using a vibratory and tension load force as defined in claim 1 wherein the first vibration/tension load absorbing element is constructed and arranged to absorb vibration and tension loads by shear strain after the tension load applied by the support exceeds the predetermined level.

3. Apparatus for driving and extracting piles using a vibratory and tension load force as defined in claim 1 wherein the housing has a first compression plate mounted thereon, wherein the vibratory unit has a second compression plate mounted thereon in spaced relation to the first compression plate so that the tension load applied by the support results in the first and second compression plates moving toward one another, and wherein the second vibration/tension load absorbing element is mounted on one of the first and second compression plates in the spacing between the first and second compression plates.

4. Apparatus for driving and extracting piles using a vibratory and tension load force as defined in claim 3 wherein the second vibration/tension load absorbing element is positioned between the first and second compression plates to stop further movement of the first and second compression plates toward one another when the second vibration/tension load absorbing element is fully compressed by the first and second compression plates, whereby the second vibration/tension load absorbing element also acts as a stop when it is fully compressed.

5. Apparatus for driving and extracting piles using a vibratory and tension load force as defined in claim 3 wherein a rigid member is mounted on one of the first and second compression plates to extend in a direction toward the other of the first and second compression plates, and wherein the extending length of the rigid member is substantially equal to the maximum height of the second vibration/tension load absorbing element when it is fully compressed between the first and second compression plates, whereby when the second vibration/tension load absorbing element is fully compressed the rigid element is engaged by one of the first and second compression plates and acts as a stop to prevent further movement of the first and second compression plates toward one another.

6. Apparatus for driving and extracting piles using a vibratory and tension load force as defined in claim 5 wherein the rigid element and the first and second compression plates are made of metal, whereby a sound is generated by the engagement of the rigid member with one of the first and second compression plates.

7. Apparatus for driving and extracting piles using a vibratory and tension load force as defined in claim 6 wherein the rigid member is a bolt, and wherein the second vibration absorbing member is held in place by the bolt and is formed with an opening through which the head of the bolt can extend to engage one of the first and second compression plates when the second vibration/tension load absorbing element is fully compressed.

8. Apparatus for driving and extracting piles using a vibratory and tension load force as defined in claim 6 wherein the rigid member is a bracket, and wherein the second vibration/tension load absorbing element is held in place by the bracket being secured to one of the first and second compression plates, and wherein the height of the bracket above the compression plate to which it is secured is substantially equal to the maximum height of the second vibration/tension load absorbing element when it is fully compressed between the first and second compression, whereby when the second vibration/tension load absorbing element is fully compressed the bracket is engaged by one of the first and second compression plates and acts as a stop to prevent further movement of the first and second compression plates toward one another.

9. Apparatus for driving and extracting piles using a vibratory and tension load force as defined in claim 8 wherein the bracket and the first and second compression plates are made of metal, whereby a sound is generated by the engagement of the bracket with one of the first and second compression plates.

10. Apparatus for driving and extracting piles using a vibratory and tension load force as defined in claim 1 wherein a plurality of first elastomeric vibration/tension load absorbing elements are mounted between the wall portion of the housing and the vibratory unit, and wherein each such first elastomeric vibration/tension load absorbing element extends generally horizontally when there is no significant tension load imposed thereon and distorts vertically under the influence of the shear strain.

11. Apparatus for driving and extracting piles using a vibratory and tension force, such apparatus comprising:

(a) a housing adapted to be connected to a support cable that lifts and lowers the housing and having at least one wall portion, the housing being provided with a first compression plate;

(b) a vibratory unit adapted to be connected to a pile and generating a vibratory force for driving and extracting a pile, the vibratory unit including a second compression plate that is positioned in spaced parallel relation to the first compression plate;

(c) a plurality of first vibration/tension load absorbing elements connected to and extending generally horizontally between the wall portion of the housing and the vibratory unit, such first vibration/tension load absorbing elements being formed of an elastomeric material for absorbing vibration and for absorbing tension loads by shear strain and being positioned to absorb by shear strain the vibration generated by the vibratory unit and to absorb the tension load applied by the support cable before and after such tension load reaches a predetermined level;

(d) at least one second vibration/tension load absorbing compression element formed of an elastomeric material and positioned between the first compression plate on the housing and second compression plate on the vibratory unit to be compressed between the first and second compression plates to absorb vibration generated by the vibratory unit and tension load applied by the support only when the tension load applied by the support cable exceeds the predetermined level; and (e) a rigid member mounted on one of the first and second compression plates to extend in a direction toward the other of the first and second compression plates, the extending length of the rigid member being substantially equal to the maximum height of the second vibration/tension load absorbing element when it is fully compressed between the first and second compression plates, whereby when the second vibration/tension load absorbing element is fully compressed the rigid element is engaged by the other of the first and second compression plates and acts as a stop to prevent further movement of the first and second compression plates toward one another.

12. Apparatus for driving and extracting piles using a vibratory and tension force, such apparatus comprising:

(a) a housing adapted to be connected to a support cable that lifts and lowers the housing and having at least one wall portion;

(b) a vibratory unit adapted to be connected to a pile and generating a vibratory force for driving and extracting a pile;

(c) a plurality of elastomeric first shear-type vibration/tension load absorbing elements connected to and extending generally horizontally between the wall portion of the housing and the vibratory unit, such first vibration/tension load absorbing element being formed of an elastomeric material for absorbing vibration and tension loads by shear strain and being positioned to absorb vibration generated by the vibratory unit and tension load applied by the support cable when the tension load applied by the support cable is above and below a predetermined level; and (d) at least one second vibration/tension load absorbing compression element formed of an elastomeric material and positioned between the housing and the vibratory unit to be compressed between the housing and the vibratory unit to absorb vibration generated by the vibratory unit and to absorb tension load applied by the support cable only when the tension load generated by the support cable exceeds a predetermined level.

13. Apparatus for driving and extracting piles using a vibratory and tension force, such apparatus comprising:

(a) a housing adapted to be connected to a support cable that lifts and lowers the housing and having at least one wall portion;

(b) a vibratory unit adapted to be connected to a pile and generating a vibratory force for driving and extracting a pile;

(c) a plurality of first shear-type vibration/tension load absorbing elements connected to and extending generally horizontally between the wall portion of the housing and the vibratory unit, such first vibration/tension load absorbing elements being formed of an elastomeric material for permitting relative movement of the housing in a direction toward and away from the vibratory unit as a result of the tension load applied by the support cable; and (d) at least one second vibration/tension load absorbing compression element formed of an elastomeric material and positioned between the housing and the vibratory unit to be compressed between the housing and the vibratory unit to absorb vibration and tension loads generated by the vibratory unit and the support only when the distance between the housing and the vibratory unit resulting from the relative movement thereof is less than a predetermined distance.

14. A method of absorbing the vibration and tension loads generated by a vibratory unit carried in the housing and connected to a pile for driving and extracting the pile, said method comprising the steps of:

(a) raising and lowering the housing and the vibratory unit using a support;

(b) absorbing the vibration generated by the vibratory unit and absorbing the tension load generated by the support utilizing shear strain; and (c) absorbing the vibration generated by the vibratory unit and absorbing the tension load generated by the support using an elastomeric compression element positioned to be compressed between the vibratory unit and the housing whenever the tension load generated by the support exceeds a predetermined level.

15. A method of absorbing the vibration and tension loads as defined in claim 14, wherein the method includes the step of generating an audible sound of metal engaging metal when the compression element positioned between the vibratory unit and the housing is fully compressed by the tension load.

16. A method of absorbing the vibration and tension loads as defined in claim 14, wherein the step of absorbing the vibration generated by the vibratory unit and absorbing the tension load generated by the support utilizing shear strain continues after the tension load exceeds the predetermined level.

17. A method of absorbing the vibration and tension loads generated by a vibratory unit carried in the housing and connected to a pile for driving and extracting the pile, said method comprising the steps of:

(a) raising and lowering the housing and the vibratory unit using a support;

(b) absorbing the vibration generated by the vibratory unit and the tension load generated by the support using shear-type vibration/tension load absorbing elements;

(c) positioning opposed compression plates on the housing and the vibratory unit so that they move toward and away from one another during the relative movement of the housing and the vibratory unit; and (d) absorbing the vibration generated by the vibratory unit and the tension load applied by the support using an elastomeric compression element positioned to be compressed between the opposed compression plates when the distance between the opposed compression plates reaches a predetermined minimum distance.

* * * * *